US007247062B1

(12) United States Patent
Polnyi

(10) Patent No.: US 7,247,062 B1
(45) Date of Patent: Jul. 24, 2007

(54) ELECTRICAL CONTACT USED IN AN ELECTRICAL SOCKET

(75) Inventor: Igor Polnyi, Aurora, IL (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/510,886

(22) Filed: Aug. 28, 2006

(51) Int. Cl.
*H01R 4/48* (2006.01)

(52) U.S. Cl. ..... 439/862

(58) Field of Classification Search ..... 439/66, 439/862

See application file for complete search history.

(56) References Cited

U.S. PATENT DOCUMENTS 5,915,988 A * 6/1999 Bitsch et al. ..... 439/398
6,113,440 A * 9/2000 Fijten et al. ..... 439/862
6,120,328 A * 9/2000 Bricaud et al. ..... 439/630
6,315,621 B1 * 11/2001 Natori et al. ..... 439/862
6,685,512 B2 * 2/2004 Ooya ..... 439/630
6,988,913 B2 * 1/2006 Zhang ..... 439/637
2005/0112959 A1 * 5/2005 Lai ..... 439/862

* cited by examiner

*Primary Examiner*—Tho D. Ta
(74) *Attorney, Agent, or Firm*—Wei Te Chung

(57) ABSTRACT

An electrical contact (1) include a retention portion (11), a solder portion (12) bending from a bottom edge of the retention portion (11), a head portion (13) extending upwardly from the retention portion (11), a spring arm (14) extending from a sidewall of the head portion (12) and a contact portion (144) formed at a topmost end of the spring arm (14). The spring arm (14) includes a body section (141) connecting with the head portion (13) and a stretching section (143) adjacent the contact portion (144), an extending portion (142) connecting the body portion (141) and the stretching portion (143). The stretching section (143) defines an elongate channel (1430), which makes the contact (1) have a preferred flexibility and an improved capability.

14 Claims, 2 Drawing Sheets

ELECTRICAL CONTACT USED IN AN ELECTRICAL SOCKET

BACKGROUND OF THE INVENTION

1. Field of the Invention

The present invention relates to electrical contacts, and more particularly to an electrical contact able to transmitting more current capability during the same time.

2. Background of the Invention

Electrical contacts are widely used in electrical socket connector to electrically bridge two electrical interfaces such as an electrical substrate, e.g. a PCB and an integrated circuit (IC) package, e.g. a central processing unit (CPU).

Referring to FIG. 1, a typical electrical contact 1' includes a main body 11', a solder tail 12', an upright head portion 13' and a spring arm 14' extends from a top end of the main body 11', and a resilient arm 141' formed at a free end of the spring arm 14', wherein the head portion 13' and the spring arm 14' are situated at two opposite sides of the central line of the main body 11', offsetting the central line a distance, respectively. A spacing is defined between the spring arm 14' and the head 13'. However, the resilient arm 141' generally has a wider width, which limits the current capacity through. In addition, Such a kind contact 1' may have inferior a typical problem of inferior flexibility, which can not need the deformation required for fitting in with the change of situation.

What is needed, thereby, is a new electrical contact able to provide a preferred current capability and a good flexibility.

SUMMARY OF THE INVENTION

An electrical contact according to a preferred embodiment of the present invention may include a retention portion, a solder portion bending from a bottom edge of the retention portion, a head portion extending upwardly from the retention portion, a spring arm extending from a sidewall of the head portion and a contact portion formed at a topmost end of the spring arm. The spring arm includes a body section connecting with the head portion and a stretching section adjacent the contact portion, an extending portion connecting the body portion and the stretching portion. The stretching section defines an elongate channel, which makes the contact have a preferred flexibility and an improved current capability.

DETAILED DESCRIPTION OF THE PREFERRED EMBODIMENT OF THE INVENTION

Figure 2:
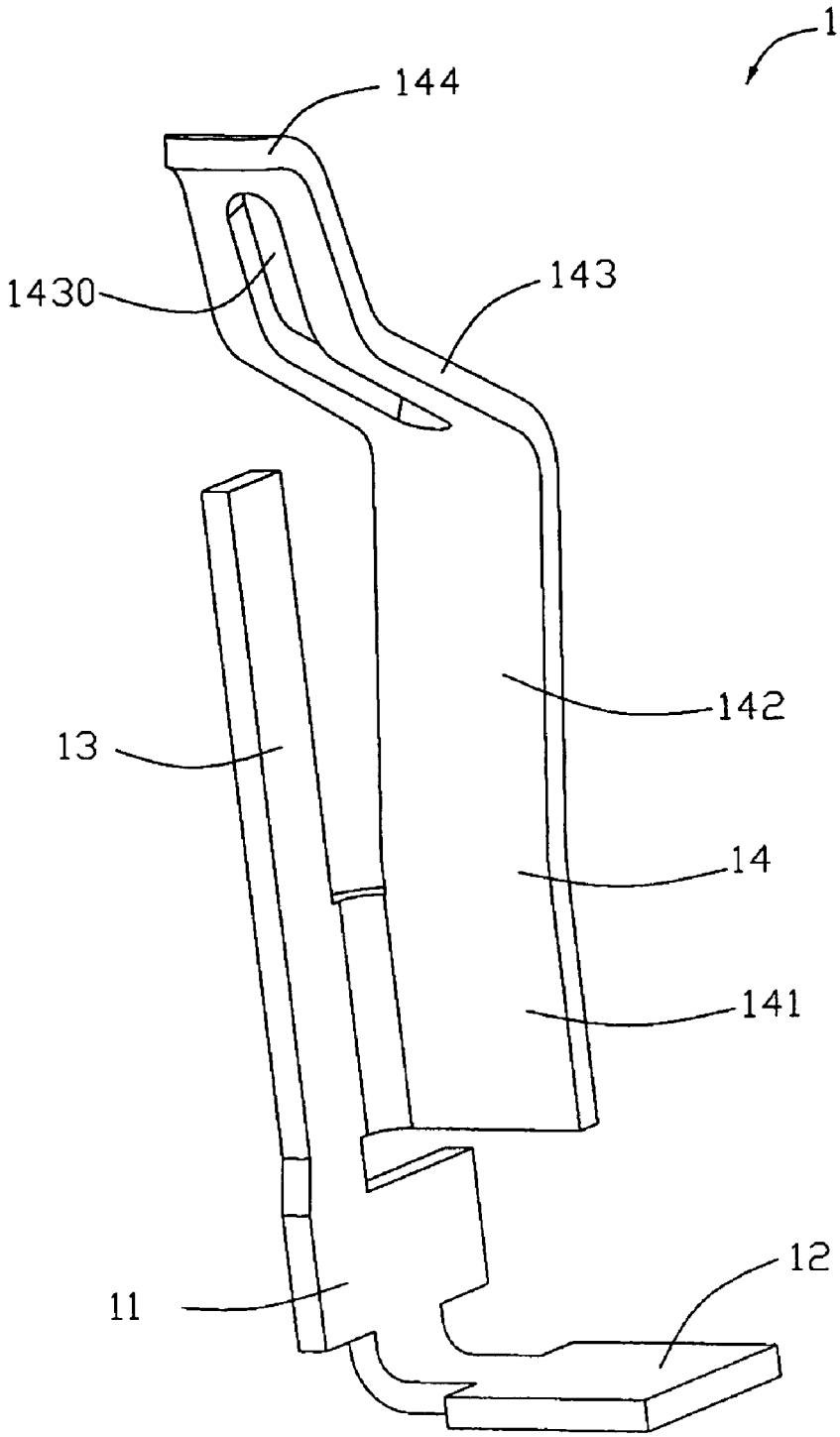
FIG. 2 is an isometric view of an electrical contact in accordance with a preferred embodiment of the present invention.

Referring to FIG. 2, an electrical contact 1 according to a preferred embodiment of the present invention is shown. The contact 1 is mainly used in an electrical socket, such as an LGA (Land Grid Array) socket (not shown), and adapted to electrically connect two interfaces, such as an IC package and a PCB (not shown), but not limited thereto.

Referring also to FIG. 2, the contact 1 is formed from conductive material and has a vertical plate-like retention portion 11 for securing in a corresponding passageway of the socket generally with a symmetrical central line (not labeled).

For more reliable position of the contact 1 in the passage of the socket, an upright head portion 13 extends from a top end of the retention portion. In this preferred embodiment, the head portion 13 is coplanar with the retention portion 11 and has a generally elongate plate-like configuration. It should be understood that the head portion 13 may be figured to have other configurations, as long as it can be fit for fixing the contact 1 more reliably in the socket.

A horizontal tail 12 bends from a bottom edge of the retention portion 11. The tail 12 is substantially perpendicular to the retention portion 11 and has a relatively larger bottom surface (not numbered) vertical to the major surface of the retention portion 11. The tail 12 is used to establish electrical connecting between the contact and the PCB via a corresponding solder member, e.g. a solder ball (not shown).

A spring arm 14 extends from a side edge of the head portion 13. Specially, an acute angle is formed between the head portion 13 and the spring arm 14. The spring arm 14 comprises a body portion 141 extending from and connecting with the head portion 13, an extending portion 142 extending upwardly from the body portion 141 with a slightly angle and spaced with the head portion 13, a stretching portion 143 extending curved from a top end of the extending portion 142. In addition, the stretching portion 143 defines an elongate channel 1430 in a center section for forming a parallel circuit, hence improving the current capability and elasticity ability thereof.

The contact 1 further has a contacting portion 144 formed at a distal end of the spring arm 14, being at a topmost part of the contact 1, for electrically engagingly mating with a corresponding conductive pad of the IC package. In this preferred embodiment, the contact portion 144 has an arced or curved configuration.

In use, the contact 1 is received in an insulative housing of the socket which serves to electrically connect the IC package and the PCB. The soldering portion 12 is electrically soldered to the PCB. The spring arm 14 produces resilient deformation by an exterior force acted on the contact 1. The contacting portion 144 urges and mates with a corresponding conductive pad of the IC package through elastic force generated by the resilient deformation of the spring arm 14. Thus, electrical connecting between the IC package and the PCB is established.

Figure 1:
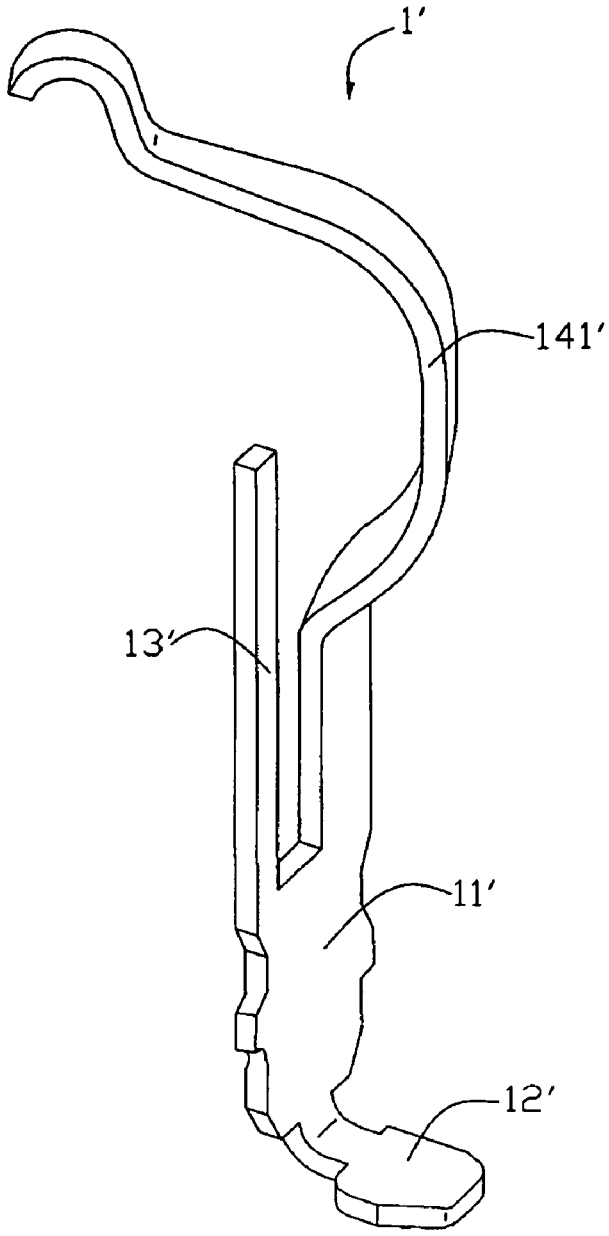
FIG. 1 PRIOR ART
FIG. 1 is an isometric view of a conventional electrical contact.

In the preferred embodiment, as the contact 1 has one elongate channel 1430 in the center section of the stretching portion 143. Therefore, the current capability of the contact 1 can be relatively larger than the typical contact 1' in FIG. 1. In addition, the design of the elongate channel 1430 improves the flexibility of the contact and decreases the material cost. As a result, the contact 1 has a preferred electrical feature and economic character, compared to the typical contact 1'.

While preferred embodiment in accordance with the present invention have been shown and described, equivalent modifications and changes known to persons skilled in the art according to the spirit of the present invention are considered within the scope of the present invention as defined in the appended claims.

What is claimed is:

1. An electrical contact comprising:

a base with a retention portion;

a head portion extending upwardly from a portion of an end of the base and coplanar with the base;

a spring portion extending upwardly and outwardly from a side of the head portion and angled therefrom;

a tail portion downward extending from a lower portion of the base;

wherein a contact portion of the spring portion defines at least one channel thereof.

2. The electrical contact as claimed in claim 1, wherein the spring portion is angled an acute angle with the head portion.

3. The electrical contact as claimed in claim 1, wherein the spring portion comprises a body portion, an extending portion extending from the body portion, a stretching portion extending from a top end of the extending portion.

4. The electrical contact as claimed in claim 3, wherein the channel is disposed on the stretching portion.

5. The electrical contact as claimed in claim 1, wherein the spring portion extends from a sidewall of the head portion and a space is defined between the spring portion and the retention portion.

6. The electrical contact as claimed in claim 5, wherein the body portion is spaced disposed with the head portion.

7. The electrical contact as claimed in claim 6, wherein further comprising a contacting portion defined on a top end of the spring portion.

8. The electrical contact as claimed in claim 7, wherein the spring portion comprises a body portion, an extending portion extending from the body portion, a stretching portion extending from a top end of the extending portion.

9. The electrical contact as claimed in claim 8, wherein the channel is disposed on a center section of the stretching portion.

10. An electrical contact comprising:

a retention portion;

a tail portion extending downwardly from a lower portion of the retention portion and being adapted for electrically engaging with an electrical component;

a head portion extending upwardly from the retention portion;

a spring arm extending from the head portion having at least one channel thereof and arranged with an acute angle with the head portion;

a contact portion disposed on a top end of the spring arm and said channel do not pass through the contact portion.

11. The electrical contact as claimed in claim 10, wherein the spring portion defines a body portion, an extending portion extending from the body portion with a slight angle, a stretching portion extending curved from the extending portion.

12. The electrical contact as claimed in claim 10, wherein the channel is defined on a center section of the stretching portion.

13. A contact for use with an electrical connector, comprising:

a vertical retention section;

an upright head portion extending from an upper end said retention section;

a spring section extending from one side edge of said upright head portion, said spring section including a body portion, an extending portion extending upwardly and outwardly from a top end of the body portion, a stretch portion extending from a top end of the extending portion and including first and second segments having different angles with regard to a horizontal plane, a contact portion formed at a top end of said stretch portion; wherein a channel extending through both said first and second segment in a thickness direction.

14. The electrical contact as claimed in claim 13, wherein the second segment linked to the contact portion, defines a steep angle than the first segment.

* * * * *